United States Patent [19]

Williamson, Jr.

[11] 4,435,909

[45] Mar. 13, 1984

[54] AUTOMATIC LINT SCREEN

[75] Inventor: John G. Williamson, Jr., Greenville, S.C.

[73] Assignee: Marshall and Williams Company, Providence, R.I.

[21] Appl. No.: 325,991

[22] Filed: Nov. 30, 1981

[51] Int. Cl.[3] ..... F26B 13/02

[52] U.S. Cl. ..... 34/82; 34/155; 55/352

[58] Field of Search ..... 34/82, 155, 77; 55/352, 55/290, 296

[56] References Cited

U.S. PATENT DOCUMENTS 2,083,141 6/1937 Buck ..... 34/82
2,218,453 10/1940 Mickle ..... 55/352
2,597,490 5/1952 Hurxthal ..... 34/82
2,713,213 7/1955 Bogaty ..... 34/82

FOREIGN PATENT DOCUMENTS 794038 4/1958 United Kingdom ..... 55/352

*Primary Examiner*—Larry I. Schwartz
*Attorney, Agent, or Firm*—Bailey & Hardaway

[57] ABSTRACT

A lint screen assembly for use in an elongated oven is provided to protect the duct work and nozzles which direct heated air against the fabric being heat treated within the range and is constructed so as to afford winding means for cleaning and rolling up a single pass of fabric intermittently in predetermined lengths for supplying fresh screen material as required.

5 Claims, 7 Drawing Figures

AUTOMATIC LINT SCREEN

BACKGROUND OF THE INVENTION

Heretofore, lint screens and the like have been provided generally in ranges having ovens equipped with penthouses wherein the screen is positioned between the main body of the oven and the penthouses across the air passageway on both sides of the fans for manual cleaning and removal. Such devices are illustrated in U.S. Pat. No. 2,083,141. It has been found in practice, that the screens become clogged because of the fact that operators neglect to properly service such manual filter devices.

Efforts to provide automatically operable lint screens which move continuously, or which move responsive to variation in pressure which would be indicative of excessive clogging have been unsuccessful. Such attempts have generally been made utilizing endless screen or belt constructions wherein a brush is of necessity provided only on the outside of the belt to remove the lint. In such devices, two passes or widths of screen move in connection with each winding device so that there is always a space between the passes. This space becomes clogged with lint which is entrapped therein because there is no place for the lint which works in between the passes of the screen to escape.

Accordingly, it is an important object of this invention to provide an improved apparatus for removing lint which becomes airborne due to impingement of heated air against the fabric being treated in the range. The lint laden air must be filtered so as to remove the airborne particles at a point in the air stram after the air is applied to the fabric and before it is returned to the heater. All webs producing lint and the like are beneficially treated through the practice of the invention, including cotton and acrylic fabrics, although usefulness with fabric constructed of monofilament nylon, for example, may be limited.

In ovens of the type wherein the invention is contemplated to be used, almost entirely recirculated air is utilized, although from about 3 to 5% air is exhausted and replaced with uncirculated air. It is important that the lint particles be intercepted by the filter or screen material so that they will not get into the duct and thus be returned to the cloth. More importantly, the duct work is to be protected and in particular, the apertures, holes, or other nozzle devices of the duct work are to be protected from clogging due to contamination with lint.

Another important object of the invention is the avoidance of fires because lint is prevented from accumulating in large collection areas, as in the dead air spaces occurring in the penthouses, which accumulations may then fall within the flames inducing a fire in the apparatus.

It is contemplated that the lint screen assembly structure of the present invention be utilized one on each side of the fans in the air passageway between the cloth and the heated area within the penthouses. It may be possible to use more than one lint screen in each position, but such must be spaced sufficiently to permit cleaning out of the areas between the single passes as well as in the structure for rolling a length of screen up on the sides of the oven.

The invention also contemplates rolling a length of lint filter screen to one side of the oven and then after such filter screen winding is complete, together with the attendant cleaning, the entire screen is again fed to the other, or feed side in a single movement from whence it is then incrementally fed preparatory through another complete rewinding cycle.

Apparatus constructed in accordance with the present invention is also useful with low profile ovens wherein the lint laden air comes off of the cloth and then down into the screen due to the negative pressure of the fan. In instances such as the low profile ovens wherein the burner or coils or electrical heaters or open flame heaters are positioned at the bottom of the body of the oven, the pass of the width of lint screen material must usually be vertical in order to cover the air passageway to the burner or other heat source.

SUMMARY OF THE INVENTION

It has been found that automatically operable lint screens for elongated industrial ovens having burners or other sources of heat, may be provided. Such structures include a single thickness of filter screen material which is wound up outside the oven on one or both sides. A track structure is provided utilizing a perforate support material such as an expanded metal. An imperforate flange is provided sealing the screen material adjacent the edges. In the event that more than one such screen is provided, sensing means indicating excessive fouling are provided, preferably for advancing the filter material of each screen independently although such motors may operate simultaneously.

BRIEF DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

The drawings illustrate a lint screen assembly for use in an elongated oven having ducts with nozzles for directing heated air against a web carried therethrough. The oven also has a heater and fans with an air passageway between the web and the heater. A transverse web filter media A serves as an elongated lint screen. A trackway B extends transversely of the oven across the air passageway. The trackway has a flange covering the edges of the lint screen media as well as a perforate support across the air passageway for backing up the screen between flanges. Power-operated means C is provided for rolling up a single width of the lint screen on one side of the oven. Means D are provided for intermittently actuating the power operated means for rolling up a length of lint screen. Means E are provided for feeding the length of lint screen from the other side of the oven. Means F in the form of a brush is provided for removing lint from the lint screen during rolling up of the lint screen.

Figure 6:
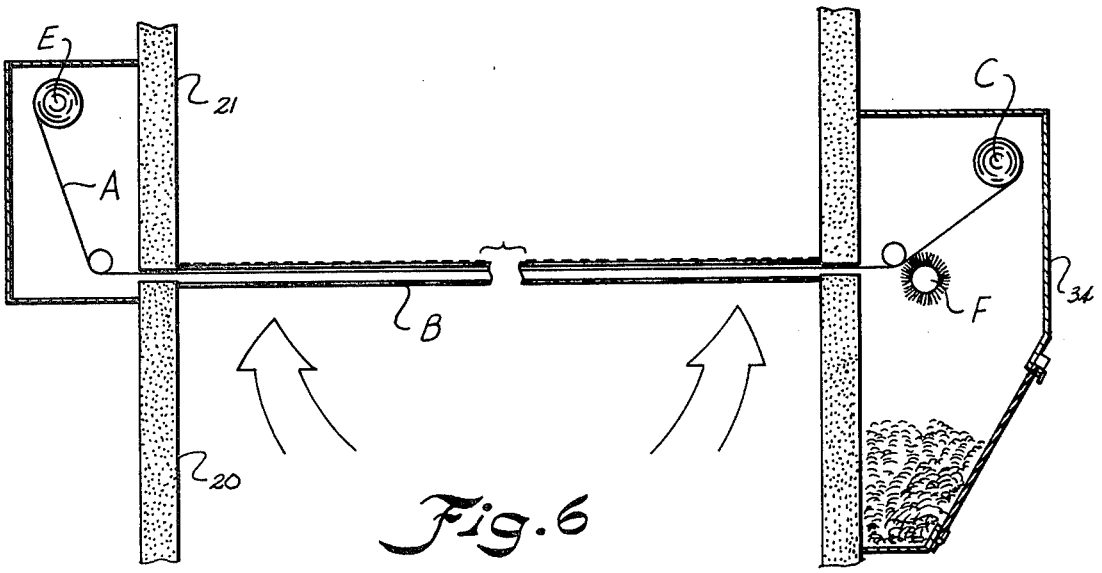
FIG. 6 is a transverse sectional elevation similar to FIG. 2 illustrating a modified form of the invention.

The means feeding the length of lint screen is alternatively useful as a power-operated means for rolling up the single width fed from one side of the oven. Power-operated means return the lint screen to the one side of the oven for subsequent intermittent feeding therefrom at all times (FIG. 6).

Figure 1:
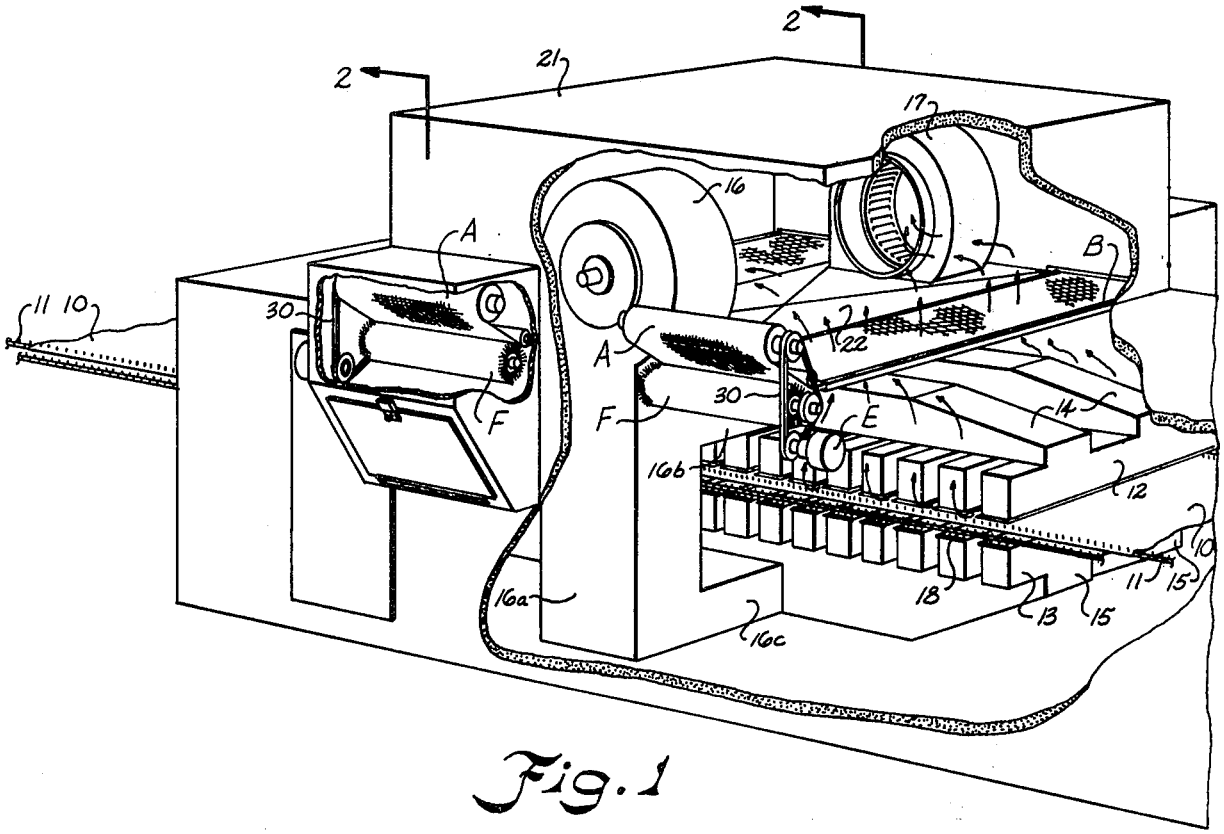
FIG. 1 is a perspective view with parts broken away illustrating a single stage of an oven of a fabric heat treating range equipped with a lint screen constructed in accordance with the present invention.
Figure 2:
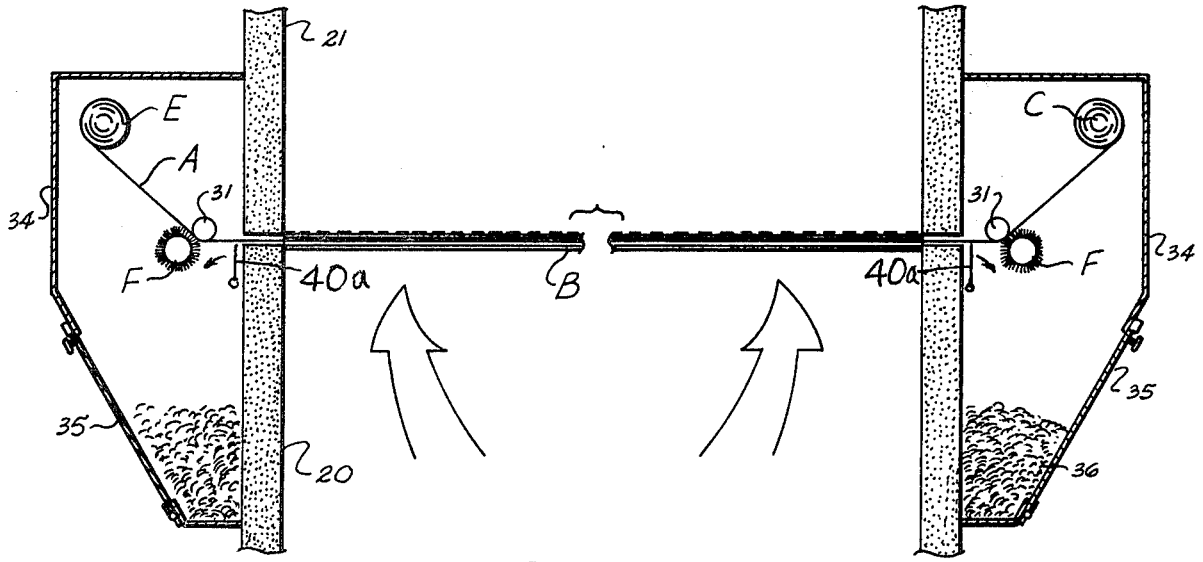
FIG. 2 is a transverse sectional elevation taken on the line 2—2 of FIG. 1.

Referring more particularly to FIGS. 1 and 2, an elongated oven is illustrated wherein cloth or fabric or other web material 10 is being carried into the oven on a tenter frame schematically illustrated at 11. It will be noted that the web 10 is carried between a spaced row of upper air ducts 12 and a lower row of air ducts 13. The ducts are supplied through spaced plenums 14 on the upper side and spaced plenums 15 on the lower side. Air is supplied to the plenums 14 and 15 from the fans 16 and 17. For this purpose, for example, a vertical duct having respective branch ducts are provided for each of the fans and in connection with fan 16, a vertical duct **16*a* has an upper branch duct 16*b* for supplying an adjacent plenum 14 while a branch duct 16*c* supplies an adjacent lower planum 15. Each of the ducts 12 and 13 is supplied with a cover plate 18** which carries a number of nozzles in the form of spaced apertures or openings therein. Such duct constructions are illustrated in U.S. Pat. No. 4,295,284 entitled DRYER RANGE, and the invention hereof may be used with this or other constructions.

FIG. 1 illustrates the main body of an oven at 20 while the penthouse 21 is carried above the main body. The main body and the penthouse have common insulated walls. An intermediate imperforate plate 22 (FIG. 1) separates the main body of the oven from the penthouse and on each side thereof and the air passageway is carried in an opening designated at 23 in FIG. 3. A pair of opposed trackways B are positioned in each of the air passageways 23.

Figure 4:
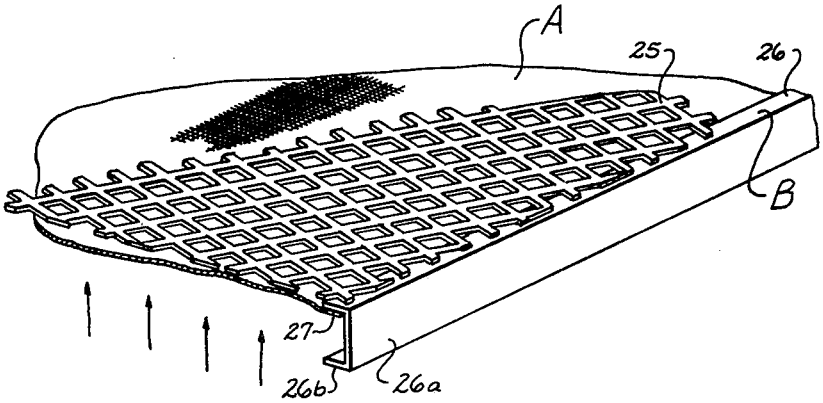
FIG. 4 is a perspective view illustrating a trackway for carrying and supporting a lint screen looking toward a near corner of one of the lint screens.

The trackways are best illustrated in FIG. 4 and the trackways include a support or backup member 25 for the lint screen media A. The support 25 is best supplied in the form of expanded metal which is carried by an imperforate flange 26 which forms part of a channel member which includes a web portion **26*a* and a lower flange 26*b* so as to constitute a structural support member for the assembly. The upward draft of air in the oven coming from the fabric 10, both from above and below, is illustrated as forcing the screen media against the expanded metal support 25 and in sealing engagement as at 27 against the imperforate flange 26**.

Figure 3:
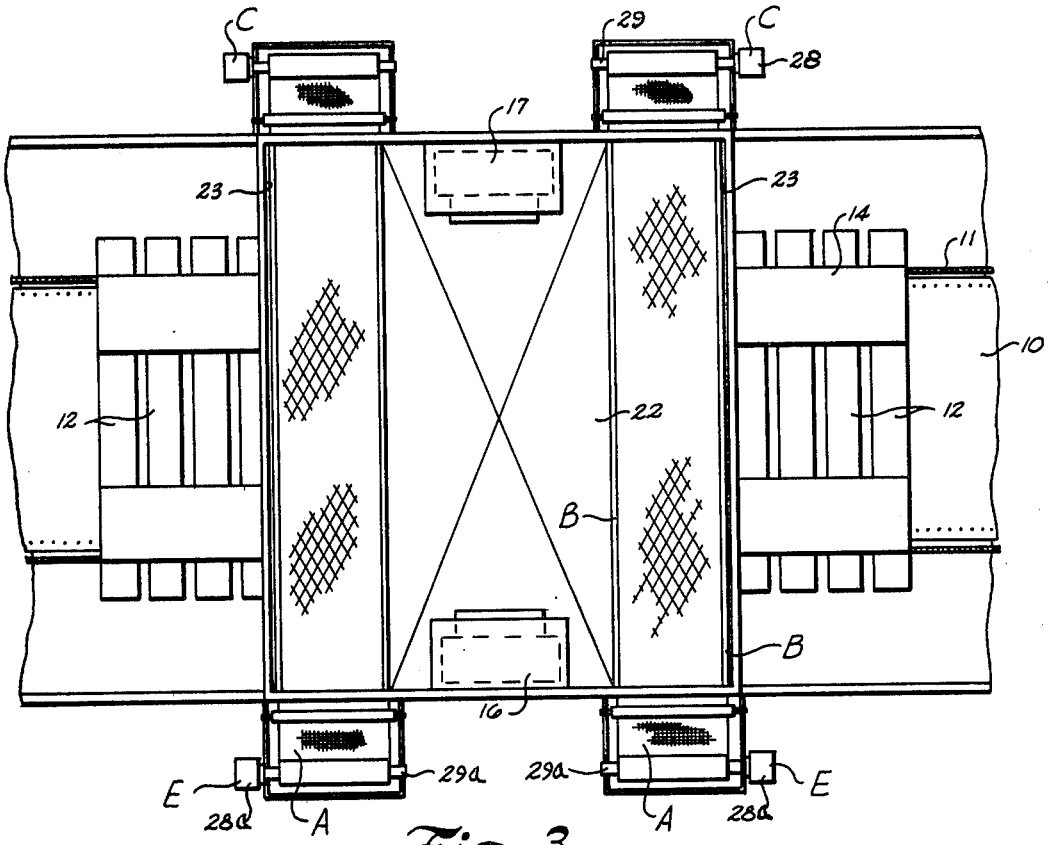
FIG. 3 is a schematic plan view of the oven illustrated in FIG. 1, and the lint screens positioned on either side of the fans.

Power-operated means C for rolling up the single width of lint screen on one side of the oven C includes a motor 28 and a reel 29 driven thereby for taking up the screen media (FIG. 3).

Figure 5:
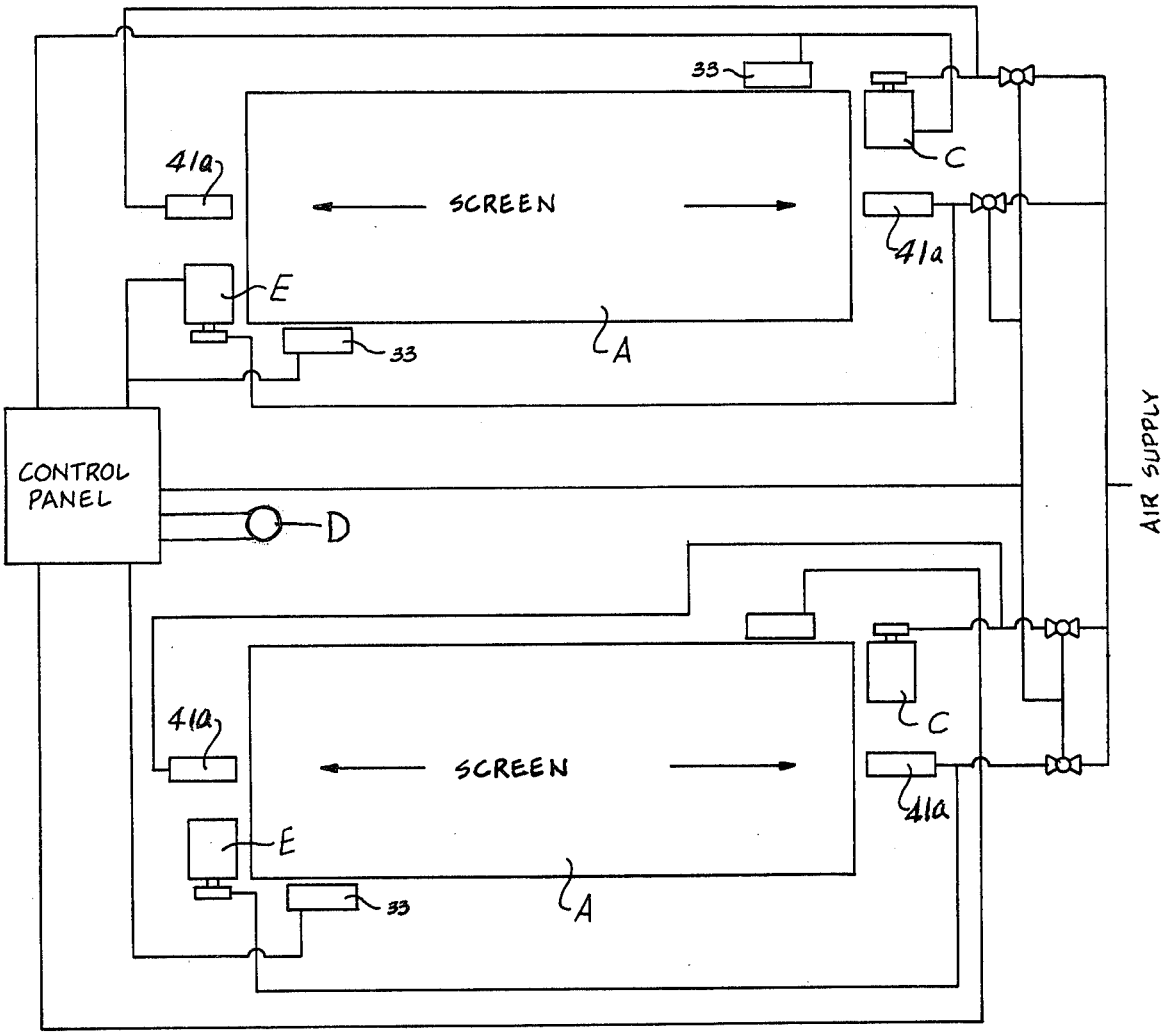
FIG. 5 is a diagram illustrating the sensing mechanism for controlling the drive of the lint screens.

Referring to FIG. 5, it will be noted that a pressure switch D may be provided for sensing pressure differentials in an appropriate fashion for determining when the screens have been excessively clogged with lint. Alternatively, a time or manual switch may be employed. While the operation may be controlled in almost any suitable fashion, it is desirable that the screens be operated intermittently rather than continuously so that effective filtering action may take place all across the respective air passageways.

It will be noted that means E includes a motor **28*a* as well as a roll takeup 29*a* for feeding the media A across the air passageway. It will also be noted that a brush F is provided for cleaning the outside of the screen in each of the embodiments herein. The screen is driven by a respective motor and is operated through a suitable belt 30 (FIG. 1). As illustrated in FIGS. 2 and 6, suitable guide rolls 31** are provided for directing the screen in appropriate relationship to the track members B.

OPERATION

When the differential in pressure across the screens is sufficient to actuate the pressure switch, the particular associated motors are actuated and start in order to wind the filter media A upon respective reels or rolls. The belt or screen A is moved until a switch 33 is tripped to signify that a fresh length of screen has been provided entirely across a respective air passageway. The tripping of a respective switch 33 de-energizes that particular screen apparatus and reverses a latching relay. The respective motor is shut down and the system is readied for the next ensuing pressure signal which will cause a respective motor to feed a fresh length of screen media in position across an air passageway. Such a cycle continues whenever a pressure switch indicates a requirement for fresh filter media.

FIG. 2 illustrates a collection box 34 carried on each side of the oven each of which has a door 35 which may be opened to remove accumulations of lint removed by a respective brush F. The accumulations of lint are illustrated at 36. In FIG. 6, only one clean out box 34 is illustrated and that, on the right hand side of FIG. 6. In FIG. 6, the media A is delivered to the roll C in increments as called for by a respective pressure switch. When the media is collected, all on the right hand side, a suitable switch (not shown) is energized in order to re-wind the filter media on the roll E on the left hand side of FIG. 6. After the media is rewound, it is then again fed incrementally to be taken up on the right hand side of FIG. 6. An extremely porous length of material may be attached to the end of the screen which will collect no lint during the short period the filter is being cleaned just prior to rewinding. The small amount of lint allowed to pass through the coarse material (not shown) is not excessively detrimental to operation of the device.

Figure 7:
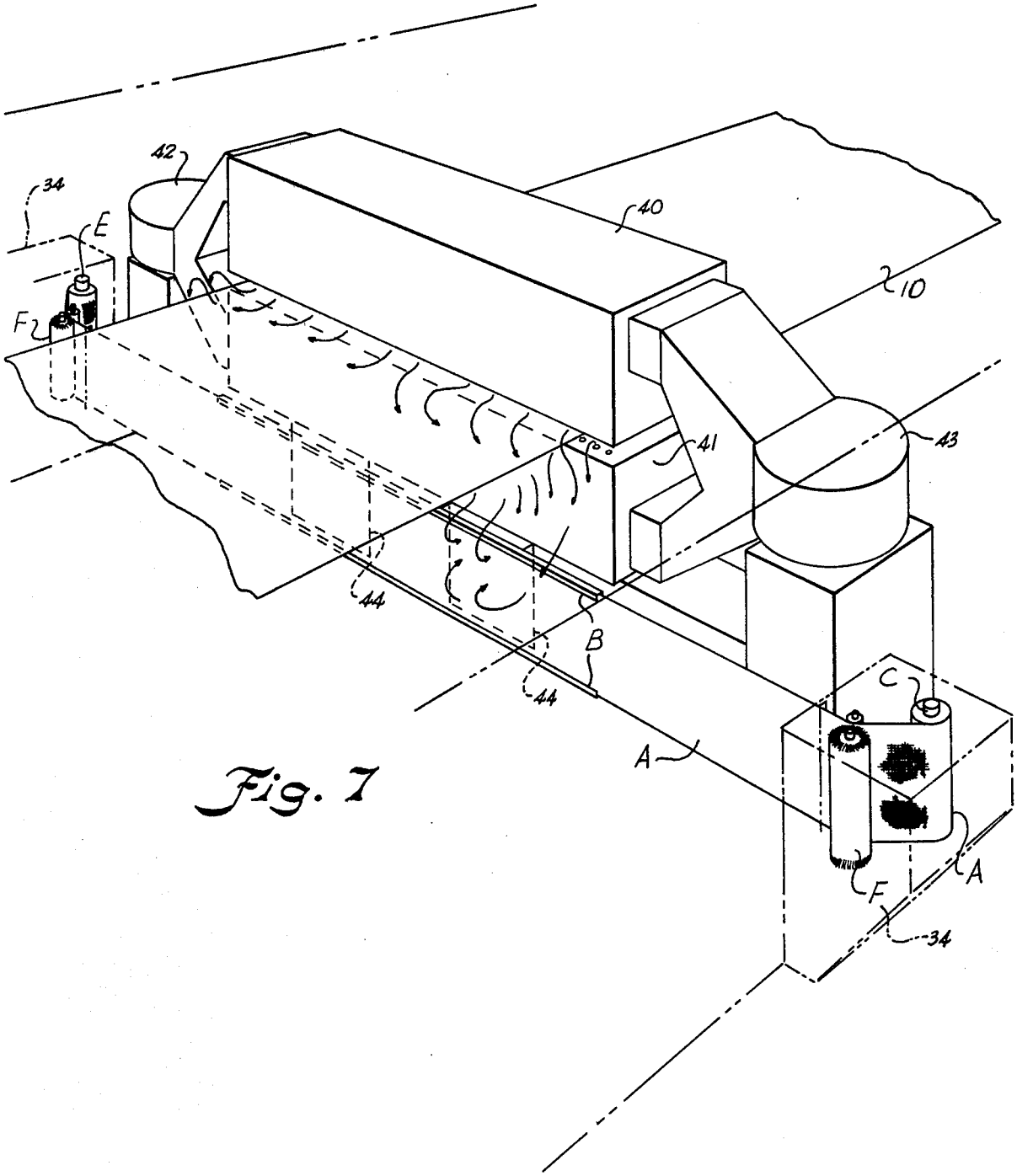
FIG. 7 is a perspective view illustrating a low profile oven equipped with a lint screen constructed in accordance with the present invention.

FIG. 7 illustrates a low profile oven wherein cloth 10 passes between ducts 40 and 41. Respective fans 42 and 43 are carried on each side of the ducts and vertical air passageways 44 are defined between opposed trackways B leading to a burner (not shown) carried in a lower portion of the oven. Since the air passageways 44 are illustrated as being vertical, the filter material or screen A is also vertical and is wound upon a roll C and fed from a roll E provided with respective rotary brushes F. Suitable cleanout boxes 34 are provided on each side of the oven.

It should be noted that hinged doors **40*a* (FIG. 2) are operated by cylinders 41*a* schematically shown in FIG. 5**. These doors are opened in the direction of the arrows to permit feeding of the screen without dislodging the collection of lint adhering thereto during withdrawal of the screen. The doors are closed at the completion of the feeding cycle to prevent influx of unwanted air into the oven. Additional sealing material (not shown) may be supplied on the other side of the screen to prevent air flow at that point.

It is thus seen that an automatic lint screen has been provided which is capable of being fed and received incrementally across respective air passageways in the flow path between the cloth and the heater mechanism for purifying the lint laden air re-circulated in industrial ovens. The filter media or screen is fed in single widths across the air passageways in order to permit adequate lint removal while tracking means are provided which include a support media for the filter between imperforate flanges which serve to seal the edges of the filter media against the escape of lint thereabout.

Since the apparatus is capable of automatic operation, an effective screening and purification of the recirculated air is assured, which manual operations are avoided.

While a preferred embodiment of the invention has been described using specific terms, such description is for illustrative purposes only, and it is to be understood that changes and variations may be made without departing from the spirit or scope of the following claims.

What is claimed is:

1. A lint screen assembly for use in an elongatd oven having ducts with nozzles for directing heated air against a web carried therethrough, said oven also having a heater and fans with an air passageway between the web and the heater extending substantially across said oven, the improvement comprising:

a transverse filter media serving as an elongated lint screen;

a trackway extending transversely of said oven entirely across said air passageway; said trackway having an imperforate flange covering the edges of said lint screen media;

power-operated means for rolling up a single width of said lint screen on one side of the oven;

an edge of said lint screen on each side thereof in sealing engagement with said imperforate flange;

means intermittently actuating said power-operated means for rolling up a length of lint screen;

means feeding said length of lint screen from the other side of the oven; and means removing lint from said lint screen during rolling up of the lint screen.

2. The structure set forth in claim 1 wherein said means feeding said length of lint screen is convertible to a power-operated means for rolling up said single width fed from said one side of the oven.

3. The structure set forth in claim 1 including power-operated means returning said lint screen to said one side of the oven for subsequent intermittent feeding therefrom at all times.

4. A lint screen assembly for use in an elongated oven having ducts with nozzles for directing heated air against a web carried therethrough, said oven also having a heater and fans with an air passageway between the web and the heater extending substantially across the oven, the improvement comprising:

a transverse filter media serving as an elongated lint screen;

a trackway extending transversely of said oven entirely across said air passageway; said trackway having an imperforate flange covering the edges of said line screen media; and a stationary flat perforate support across said air passageway for backing up the screen between flanges;

power-operated means for rolling up a single width of said lint screen on one side of the oven;

means actuating said power-operated means for rolling up a length of lint screen;

an edge of said lint screen on each side thereof in sealing engagement with said imperforate flange means for feeding said length of lint screen from the other side of the oven; and rotary brush means removing lint from said lint screen during rolling up of the lint screen.

5. The structure set forth in claim 1 wherein said perforate support is constructed of expanded metal and said flange is carried by a generally channel-shaped track member.

* * * * *